US008696491B1

(12) United States Patent
Myers

(10) Patent No.: US 8,696,491 B1
(45) **Date of Patent: *Apr. 15, 2014**

(54) GOLF CLUB HEAD WITH ADJUSTABLE CENTER OF GRAVITY

(71) Applicant: Callaway Golf Company, Carlsbad, CA (US)

(72) Inventor: Matthew Myers, Carlsbad, CA (US)

(73) Assignee: Callaway Golf Company, Carlsbad, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/033,218

(22) Filed: Sep. 20, 2013

Related U.S. Application Data

(63) Continuation-in-part of application No. 13/923,571, filed on Jun. 21, 2013, which is a continuation-in-part of application No. 13/778,958, filed on Feb. 27, 2013.

(60) Provisional application No. 61/727,608, filed on Nov. 16, 2012.

(51) Int. Cl.
*A63B 53/04* (2006.01)

(52) U.S. Cl.
USPC ..... 473/334; 473/345; 473/349

(58) Field of Classification Search
USPC ..... 473/324–350
See application file for complete search history.

(56) References Cited

U.S. PATENT DOCUMENTS 4,065,133 A * 12/1977 Gordos ..... 473/327
D275,412 S * 9/1984 Simmons ..... D21/752
4,895,371 A * 1/1990 Bushner ..... 473/336
5,292,129 A * 3/1994 Long et al. ..... 473/346
5,464,217 A * 11/1995 Shenoha et al. ..... 473/350
5,497,995 A * 3/1996 Swisshelm ..... 473/350

(Continued)

FOREIGN PATENT DOCUMENTS

JP 6-238022 8/1994
JP 2002320691 A * 11/2002 ..... A63B 53/04

(Continued)

OTHER PUBLICATIONS

TaylorMade SLDR Driver. [online]. [retrieved on Aug. 7, 2013]. Retrieved from the Internet: <URL:http://taylormadegolf.com/taylormade/sldr-driver/DW-SQ035.html>.

(Continued)

*Primary Examiner* — Alvin Hunter

(74) *Attorney, Agent, or Firm* — Rebecca Hanovice; Michael A. Catania; Sonia Lari

(57) ABSTRACT

A golf club head comprising a channel and an expandable weight that can be removably fixed at any point within the channel is disclosed herein. The channel preferably is disposed on the sole and extends from a heel side of the golf club head, around a rear side, and ends at a toe side of the golf club head. This channel is not constrained to a planar arc, but instead twists as it extends around the golf club head so that it follows the contours, and preserves the aesthetics, of the golf club head. The expandable weight preferably is trapped within the channel so that it cannot fall out of the channel during use, and includes an anti-rotation feature so that it does not twist within the channel and cause an undesirable rattling noise.

13 Claims, 16 Drawing Sheets

(56) References Cited

U.S. PATENT DOCUMENTS

| | | | | |
|---|---|---|---|---|
| 5,688,189 | A | 11/1997 | Bland | |
| 5,735,754 | A * | 4/1998 | Antonious | 473/328 |
| D413,952 | S * | 9/1999 | Oyer | D21/752 |
| 6,015,354 | A | 1/2000 | Ahn et al. | |
| 6,257,991 | B1 * | 7/2001 | Ortiz | 473/309 |
| 6,379,264 | B1 | 4/2002 | Forzano | |
| 6,575,845 | B2 * | 6/2003 | Galloway et al. | 473/329 |
| 6,749,523 | B1 | 6/2004 | Forzano | |
| D498,508 | S * | 11/2004 | Antonious | D21/752 |
| 6,890,267 | B2 * | 5/2005 | Mahaffey et al. | 473/256 |
| 7,108,609 | B2 | 9/2006 | Stites et al. | |
| 7,147,573 | B2 | 12/2006 | DiMarco | |
| 7,166,041 | B2 * | 1/2007 | Evans | 473/334 |
| 7,201,669 | B2 | 4/2007 | Stites et al. | |
| 7,452,286 | B2 * | 11/2008 | Lin et al. | 473/334 |
| 7,500,924 | B2 * | 3/2009 | Yokota | 473/332 |
| 7,520,820 | B2 | 4/2009 | DiMarco | |
| 7,530,901 | B2 * | 5/2009 | Imamoto et al. | 473/334 |
| 7,572,193 | B2 * | 8/2009 | Yokota | 473/328 |
| 7,611,424 | B2 * | 11/2009 | Nagai et al. | 473/334 |
| 7,775,905 | B2 * | 8/2010 | Beach et al. | 473/334 |
| 7,824,280 | B2 * | 11/2010 | Yokota | 473/334 |
| 7,854,667 | B2 | 12/2010 | Gillig | |
| 7,927,231 | B2 | 4/2011 | Sato et al. | |
| 7,988,565 | B2 * | 8/2011 | Abe | 473/328 |
| 8,016,694 | B2 * | 9/2011 | Llewellyn et al. | 473/334 |
| 8,192,303 | B2 | 6/2012 | Ban | |
| 8,202,175 | B2 | 6/2012 | Ban | |
| 8,206,243 | B2 * | 6/2012 | Stites | 473/334 |
| 8,216,087 | B2 | 7/2012 | Breier et al. | |
| 8,235,841 | B2 * | 8/2012 | Stites et al. | 473/328 |
| 8,235,844 | B2 * | 8/2012 | Albertsen et al. | 473/345 |
| 8,308,583 | B2 | 11/2012 | Morris et al. | |
| 8,403,771 | B1 * | 3/2013 | Rice et al. | 473/328 |
| 8,435,134 | B2 * | 5/2013 | Tang et al. | 473/329 |
| 8,444,505 | B2 | 5/2013 | Beach et al. | |
| D686,679 | S * | 7/2013 | Greensmith et al. | D21/759 |
| 8,517,860 | B2 * | 8/2013 | Albertsen et al. | 473/329 |
| 8,591,351 | B2 * | 11/2013 | Albertsen et al. | 473/329 |
| 2004/0138002 | A1 * | 7/2004 | Murray | 473/327 |
| 2006/0122004 | A1 * | 6/2006 | Chen et al. | 473/335 |
| 2006/0172821 | A1 * | 8/2006 | Evans | 473/349 |
| 2006/0240908 | A1 | 10/2006 | Adams et al. | |
| 2008/0020861 | A1 | 1/2008 | Adams et al. | |
| 2008/0261715 | A1 * | 10/2008 | Carter | 473/291 |
| 2010/0075773 | A1 * | 3/2010 | Casati, Jr. | 473/334 |
| 2010/0292027 | A1 | 11/2010 | Beach et al. | |

FOREIGN PATENT DOCUMENTS

| | | |
|---|---|---|
| JP | 2005-323978 | 11/2005 |
| JP | 2006-320493 | 11/2006 |
| JP | 2006320493 A * | 11/2006 |

OTHER PUBLICATIONS

Kick X Golf Tracker SRT. [online]. [retrieved on Aug. 7, 2013]. Retrieved from the Internet: <URL:http://kickxgolf.com/tracker-srt.aspx>.

* cited by examiner

GOLF CLUB HEAD WITH ADJUSTABLE CENTER OF GRAVITY

CROSS REFERENCES TO RELATED APPLICATIONS

The present application is a continuation-in-part of U.S. patent application Ser. No. 13/923,571, filed on Jun. 21, 2013, which is a continuation-in-part of U.S. patent application Ser. No. 13/778,958, filed on Feb. 27, 2013, which claims priority to U.S. Provisional Patent Application No. 61/727,608, filed on Nov. 16, 2012, the disclosure of each of which is hereby incorporated by reference in its entirety herein.

STATEMENT REGARDING FEDERALLY SPONSORED RESEARCH OR DEVELOPMENT

Not Applicable

BACKGROUND OF THE INVENTION

1. Field of the Invention

The present invention relates to a golf club head. More specifically, the present invention relates to a weight for a golf club head that can be adjusted along a continuous channel.

2. Description of the Related Art

The ability to adjust center of gravity location and weight in the head of driving clubs is useful for controlling performance of the golf club. The prior art includes several different solutions for adjustable weighting, but these solutions do not optimize weight adjustment. There is a need for a weighting mechanism that allows for simple and flexible center of gravity (CG) and moment of inertia (MOI) adjustability.

BRIEF SUMMARY OF THE INVENTION

The present invention is a novel way of working with adjustable products. The present invention allows consumers to easily move and fix a weight at any location within a channel disposed in the golf club head in such a way to maximize aesthetic appearances while preserving the function of the movable weight. The objective of this invention is to provide an adjustable weight with minimal or no effect on appearance at address while maximizing the ability of the weight to adjust center of gravity height. Additional goals include minimizing the fixed component of the structure dedicated to the weighting system and also minimizing any potential effect on impact sound. Yet another object of the present invention is an adjustable weighting feature for lateral or vertical center of gravity control which is placed to maximize effectiveness and may be entirely concealed from view at address.

One aspect of the present invention is a golf club head comprising a crown, a sole, a hosel, a heel side, a toe side, a face, a rear side opposite the face, an edge portion where the crown connects with the sole, and a channel having a curvature, wherein the channel is disposed in one of the crown and the sole, wherein the channel comprises walls having at least two sides and a floor, wherein the area of a cross-section of the channel taken in a direction normal to the edge portion is constant along the channel, wherein the channel extends from the heel side to the toe side via the rear side and proximate the edge portion along one of the crown and the sole, and wherein the curvature of the channel is not constrained to a planar arc. In some embodiments, a distance between the edge portion and an edge of the channel located closest to the edge portion may remain constant for at least 50% of the length of the channel. In other embodiments, the golf club head may be a wood-type golf club head. In some embodiments, the crown may be composed of a carbon material, and the sole and face portion may be composed of a titanium alloy material.

In some embodiments, the channel may be disposed in the sole, and a heel-most end of the channel may be closer to the face than a toe-most end of the channel. In other embodiments, the channel may be in communication with a weight port. In some embodiments, the channel may have a depth of no less than 0.250 inch and no more than 0.750 inch and a maximum width of no less than 0.250 inch and no more than 0.750 inch. In a further embodiment, the channel may have a depth of approximately 0.500 inch and a maximum width of approximately 0.500 inch. In other embodiments, the at least two sides may be curved and the floor may be planar.

Another aspect of the present invention is a golf club head comprising a body comprising a crown, a sole, a heel side, a toe side, a face portion, and a rear side, an edge portion where the crown connects with the sole, and a channel, and an expandable weight that is disposed within and movable to any location within the channel, wherein the channel comprises walls having at least two curved sides and a planar floor, wherein the channel extends from the heel side to the toe side via the rear side along one of the crown and the sole, wherein the channel twists relative to a plane intersecting the golf club head at the edge portion as the channel extends around the body, and wherein expanding the weight reversibly flxes it in place within the channel. In some embodiments, a distance between the edge portion and a midpoint of the channel remains constant for at least 50% of the length of the channel. In other embodiments, the channel may comprise a channel axis that extends normal to the floor of the channel, and the angle between the channel axis and the plane may not remain constant along the channel. In some embodiments, the channel may comprise a narrowed portion, and the expandable weight may comprise an upper surface with hooked upper edges which extend over the narrowed portion. In some embodiments, moving the weight within the channel may change both a moment of inertia and a location of a center of gravity of the golf club head.

Yet another aspect of the present invention is a wood-type golf club head comprising a metal body comprising a sole, a heel side, a toe side, a face, an upper opening, and a rear side opposite the face, and a composite crown affixed to the metal body to close the upper opening, wherein an edge portion defines the points around the club head where the composite crown connects with the sole, wherein an edge plane intersects the edge portion, wherein a channel comprising walls having at least two curved sides and a planar floor is disposed within the sole, wherein the channel extends from the heel side to the toe side via the rear side and proximate the edge portion along the sole, wherein the channel twists relative to the edge plane as the channel extends around the body, and wherein the area of a cross-section of the channel taken in a direction normal to the edge portion is constant along the channel. In some embodiments, the golf club head may further comprise an expandable weight sized to fit within the channel, the weight may comprise an upper piece, a lower piece, and a bolt connecting the upper and lower pieces, and wherein the weight is removably fixed at any location within the channel. In a further embodiment, the expandable weight may comprise an anti-rotation feature. In some embodiments, the channel may have a depth of no less than 0.250 inch and no more than 0.750 inch and a maximum width of no less than 0.250 inch and no more than 0.750 inch. In another embodiment, the golf club head may be a driver-type head.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

Figure 1:
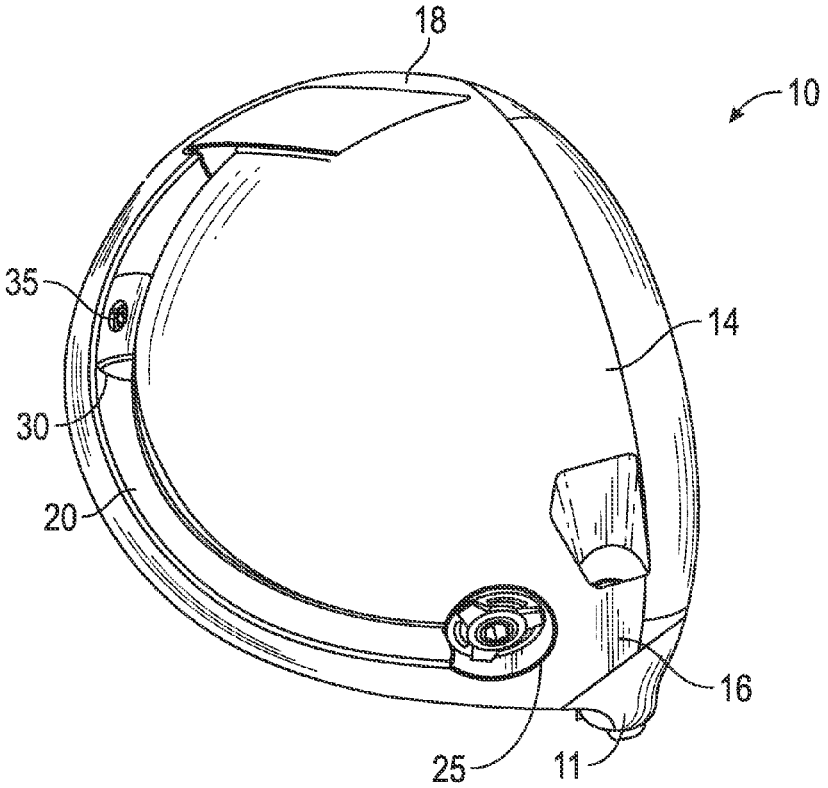
FIG. 1 is a bottom perspective view of a golf club head encompassing a first embodiment of the present invention.
Figure 2:
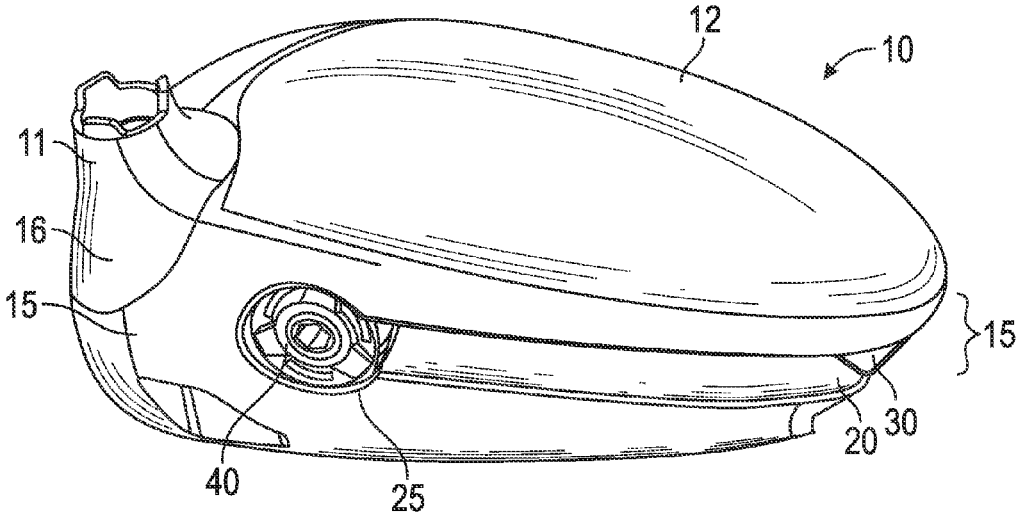
FIG. 2 is a first side perspective view of the embodiment shown in FIG. 1.
Figure 3:
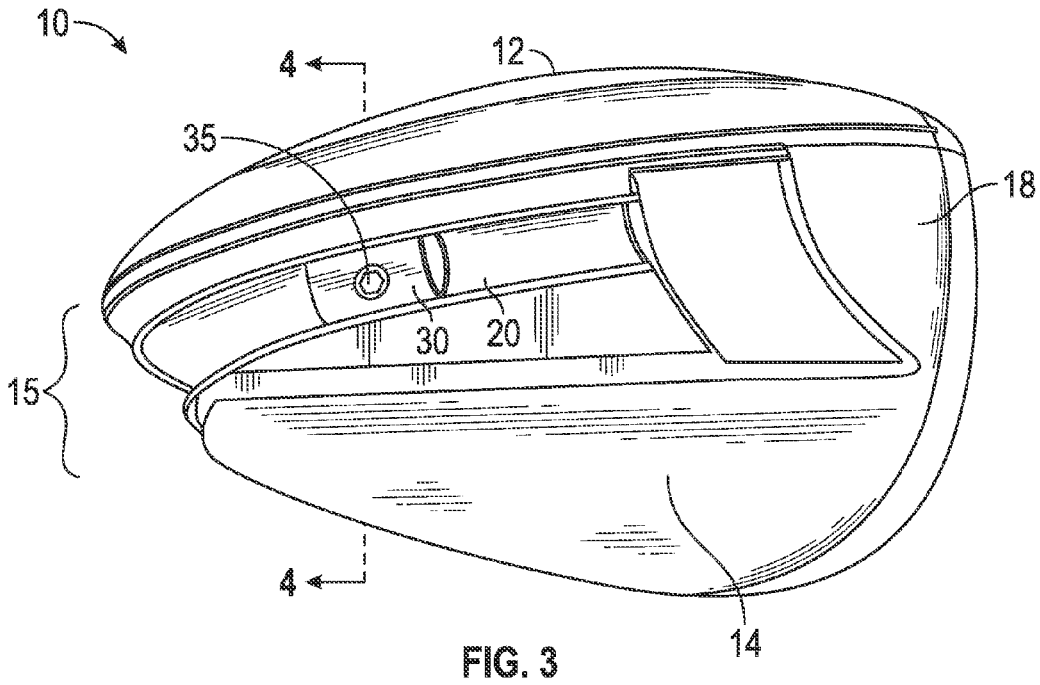
FIG. 3 is a second side perspective view of the embodiment shown in FIG. 1.

The design approaches described herein are based on a construction used in a driver head characterized by a composite crown adhesively bonded to a cast titanium body. This particular construction approach permits the crown configuration to be adapted to the inventive weighting scheme with minimal impact on weight and function. However, the weighting embodiments disclosed herein can be used with other constructions, including all titanium, all composite, and a composite body with metal face cup. It can also work in conjunction with at least one adjustable weight port on the sole of the driver head. Shifting weight along the channel described herein allows for control of center of gravity location.

A first embodiment of the present invention is shown in FIGS. 1-4. The golf club head 10 comprises a channel 20 disposed within a side or ribbon 15 portion of the golf club head 10, but may in alternative embodiments may be disposed in the crown 12 and/or sole 14. The channel 20 extends from a heel side 16 of the club head proximate a hosel 11 to a toe side 18 of the golf club head 10, and has a curved cross-sectional shape with an internal width W1 that is greater than an external opening width W2. The channel 20 may have any of the configurations disclosed in U.S. patent application Ser. No. 13/656,271, the disclosure of which is hereby incorporated by reference in its entirety herein.

Figure 4:
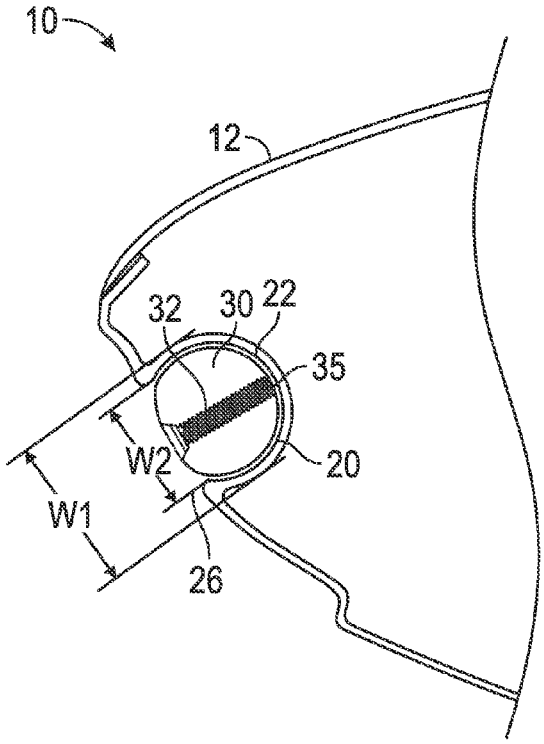
FIG. 4 is a cross-sectional view of the embodiment shown in FIG. 3 along lines 4-4.
Figure 5:
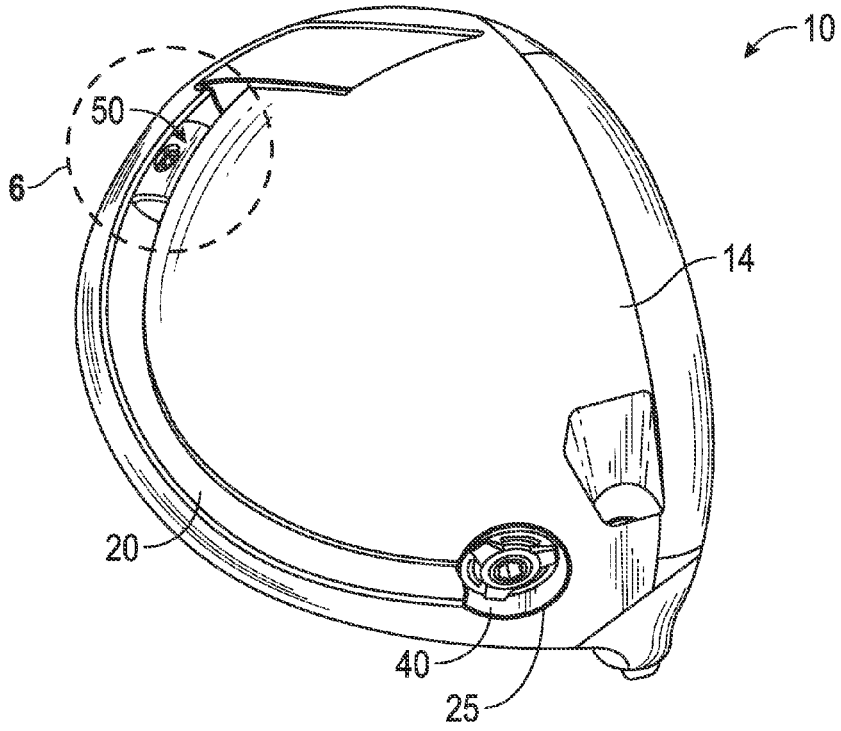
FIG. 5 is a bottom perspective view of a golf club head encompassing a second embodiment of the present invention.

A slidable weight 30 is disposed within the channel 20, and is inserted into the channel 20 at an opening 25 proximate the heel 16, which is closed with a weight screw 40 or a lightweight plug once the slidable weight 30 is inserted into the channel 20. The weight screw 40 or plug and slidable weight 30 can be made of any material known to a person of ordinary skill in the art, and can be selected to better adjust mass properties of the club head. Once the opening 25 is closed, the slidable weight 30 is trapped within the channel 20, though removing the weight screw 40 or the plug allows the slidable weight 30 to be removed and exchanged for one having different structural and/or material characteristics. As shown in FIGS. 1-4, the slidable weight 30 has a greater width than the width W2 of the opening 26 of the channel 20, preventing it from falling out of the channel 20 during use, but has dimensions that allow it to easily slide along the length of the channel 20. In this embodiment, the slidable weight 30 is fixed within the channel at a desired location with a screw 35 that extends through a bore 32 in the slidable weight 30 to engage a floor portion 22 of the channel 20 as shown in FIG. 4 and press the slidable weight 30 against the edges of the opening 26 of the channel 20. In alternative embodiments, the slidable weight 30 is fixed within the channel at a desired location by any means known to a person of ordinary skill in the art, including with a semi-permanent adhesive or one or more of the mechanisms disclosed in U.S. Pat. No. 7,147,573 to DiMarco and U.S. Pat. No. 7,166,041 to Evans, the disclosure of each of which is hereby incorporated by reference in its entirety herein.

Figure 6:
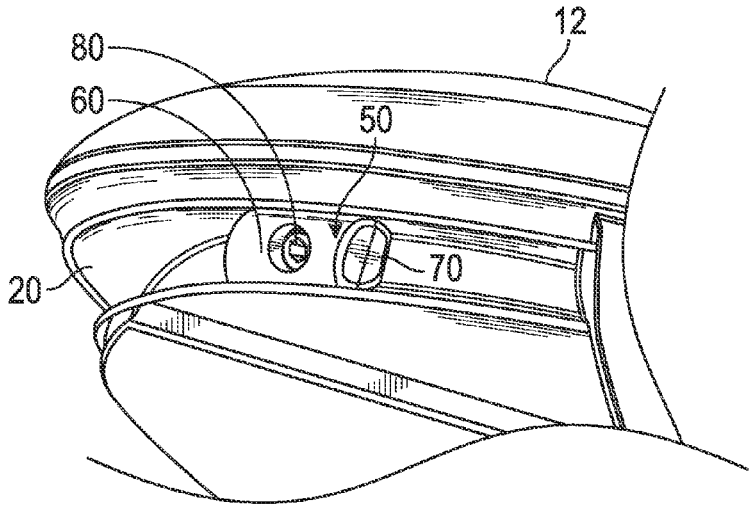
FIG. 6 is an enlarged view of the circled portion in FIG. 5, with the weight in a movable configuration.
Figure 7:
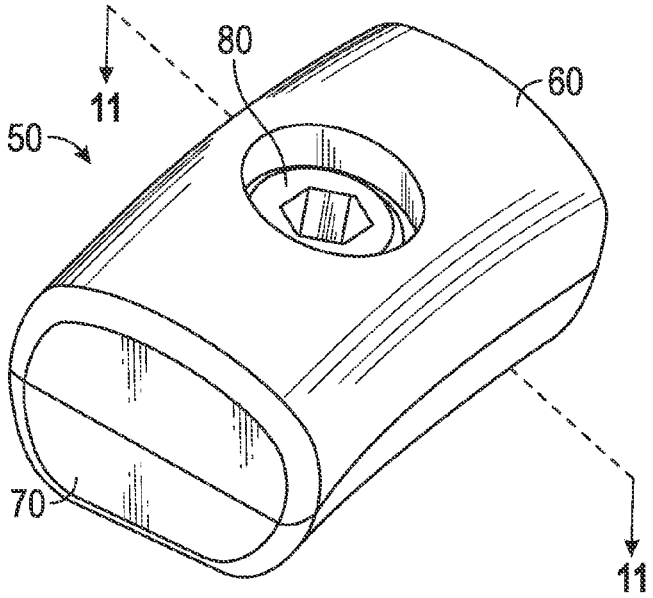
FIG. 7 is a side perspective view of the weight shown in FIG. 6.
Figure 8:
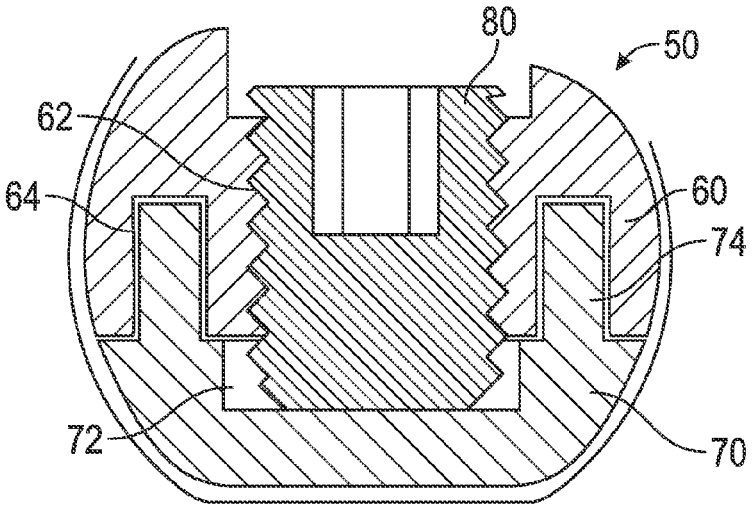
FIG. 8 is a cross-sectional view of the weight shown in FIG. 7 along lines 8-8.

A second embodiment of the present invention is shown in FIGS. 5-11. In this embodiment, the golf club head 10 includes the channel 20, opening 25, and weight screw 40 of the first embodiment, but the slidable weight 50 of this embodiment is semi-permanently fixed within the channel 20 via an expandable, multi-piece construction. As shown in FIGS. 6-11, the slidable weight 50 comprises an upper portion 60 having a threaded bore 62 and a depression 64, a lower portion 70 having a cavity 72 and a projection 74, and a bolt 80, though in an alternative embodiment the upper portion 60 may have a projection and the lower portion 70 may have a depression. As shown in FIG. 8, the projection 74 of the lower portion 70 fits within the depression 64 of the upper portion 60 and prevents the slidable weight 50 from falling apart as it is moved within the channel 20 of the present invention.

Figure 9:
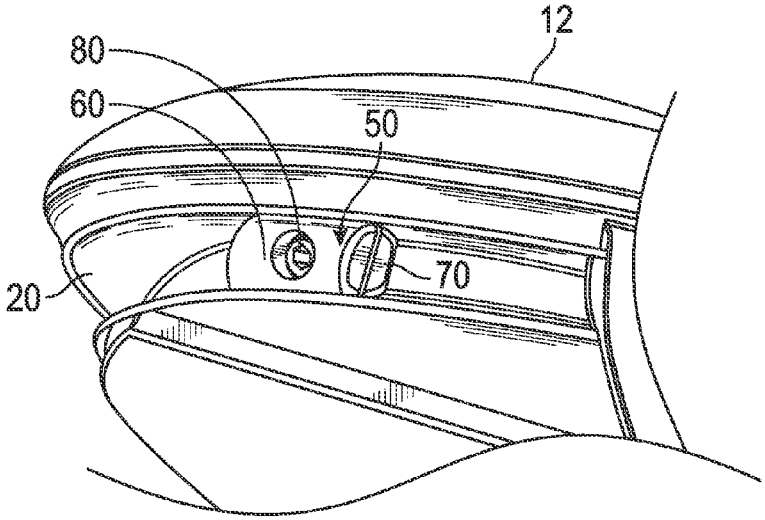
FIG. 9 is an enlarged view of the circled portion in FIG. 5, with the weight in a fixed configuration.
Figure 10:
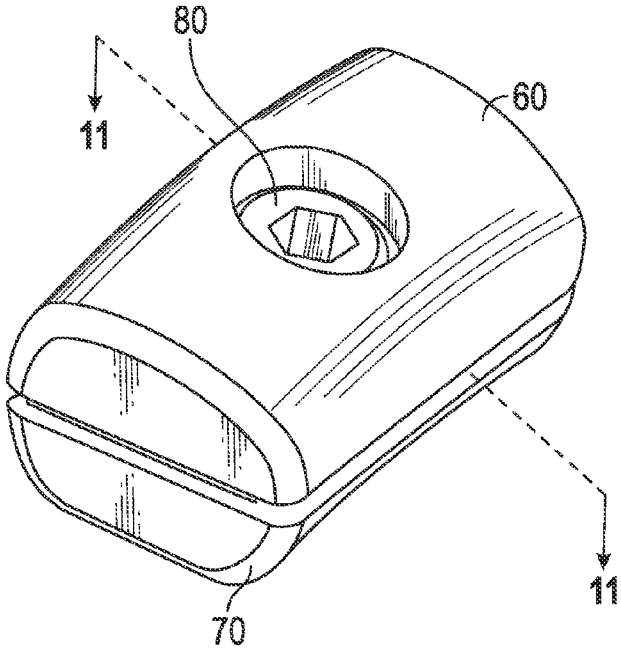
FIG. 10 is a side perspective view of the weight shown in FIG. 9.
Figure 11:
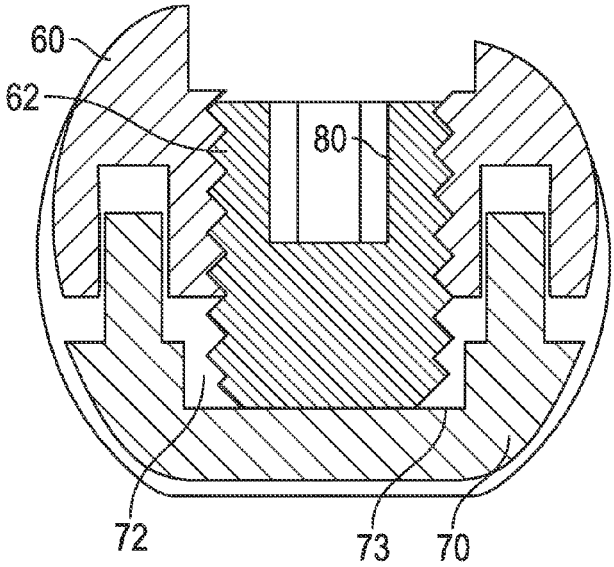
FIG. 11 is a cross-sectional view of the weight shown in FIG. 10 along lines 11-11.

While in the configuration shown in FIGS. 6-8, the dimensions of the slidable weight 50 are such that the slidable weight 50 fits loosely within the channel 20 and can be moved along the length of the channel 20, though the slidable weight 50 still has a width that is great enough to prevent it from falling out of the channel 20. When a golfer has moved the slidable weight 50 to a desired position within the channel 20, he or she can tighten the bolt 80, which causes the bolt 80 to move downward within the threaded bore 62, press against the floor 73 of the cavity 72 of the lower portion 70 of the weight, and push the upper portion 60 of the slidable weight 50 away from the lower portion 70, as shown in FIGS. 9-11. As it is pushed upwards, the upper portion 60 of the slidable weight 50 presses against the sides of the channel 20, effectively using friction to wedge the slidable weight 50 into a fixed position within the channel 20. In the embodiment shown in FIGS. 6-8, at least one, and preferably both, of the upper portion 60 and lower portion 70 of the slidable weight 50 is composed of a metal material, particularly stainless steel, that is co-molded with a polymeric material, and preferably rubber, to increase friction between the slidable weight 50 and the walls of the channel 20 and more securely fix the slidable weight 50 within the channel 20.

Because the opening of the channel 20 has a smaller width W2 than the width of the slidable weight 50, the slidable weight 50 does not fall out of the channel 20 when it is in its expanded configuration. In this way, the slidable weight 50 can be reversibly fixed at any location within the channel 20, not just at points within the channel 20 that have predetermined openings or notches as required in prior art clubs such as those disclosed in U.S. Pat. Nos. 7,611,424 and 8,016,694.

Figure 12:
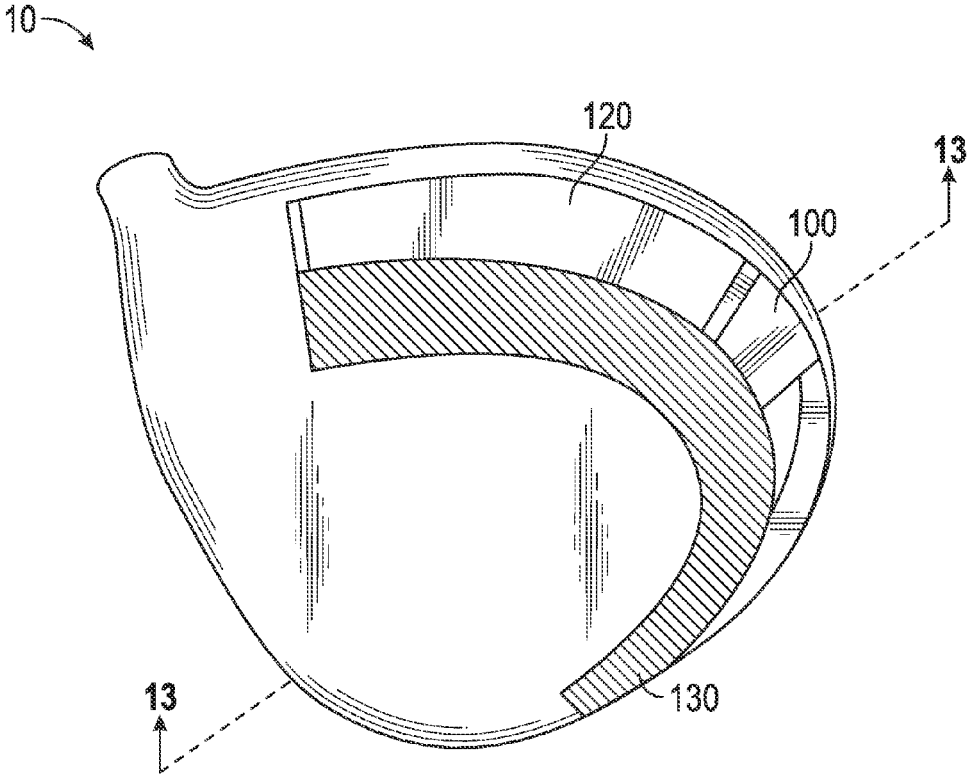
FIG. 12 is a bottom perspective view of a golf club head encompassing a third embodiment of the present invention.
Figure 13:
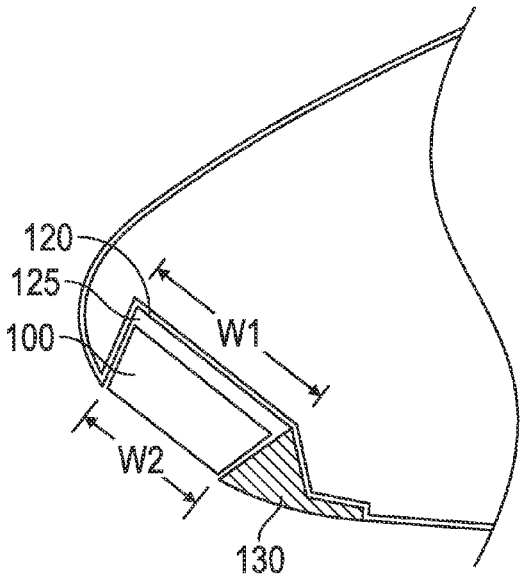
FIG. 13 is a cross-sectional view of the embodiment shown in FIG. 12 along lines 13-13.

A third embodiment of the present invention is shown in FIGS. 12 and 13. In this embodiment, the slidable weight 100 is trapezoidal, and the channel 120 is formed from a recessed part 125 of the sole 14 or ribbon 15 of the golf club head 10 and a cover fixture 130 that traps the slidable weight 100 within the channel 20. This embodiment may include a weight screw 40 or plug as disclosed in the first and second embodiments, but it is not necessary in order to trap the slidable weight 100 within the channel 120. In order to assemble this embodiment, the slidable weight 100 is placed within the recessed part 125 and the cover fixture 130 is permanently or removably affixed to the sole 14 or ribbon 15. The slidable weight 100 may be fixed at any location within the channel 120 using any of the means disclosed herein. As in the other embodiments disclosed herein, the slidable weight 100 has a width that is larger than the width W2 of the opening of the channel 120, preventing the slidable weight 100 from falling out of the channel 120 during use.

Figure 14:
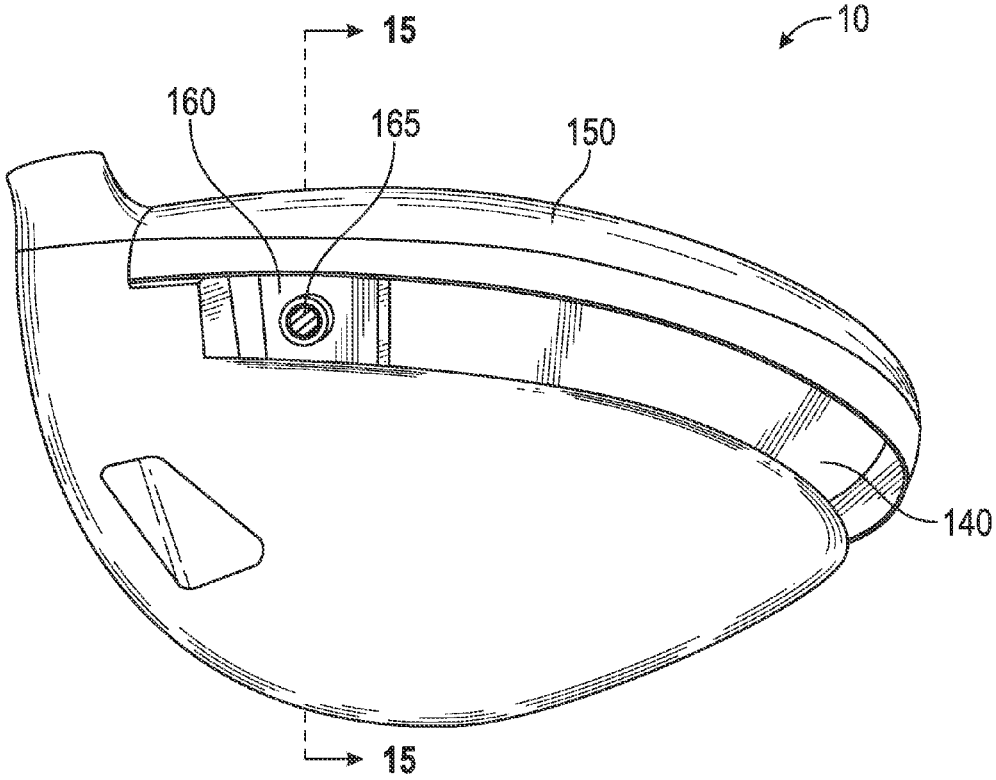
FIG. 14 is a side perspective view of a golf club head encompassing a fourth embodiment of the present invention.
Figure 15:
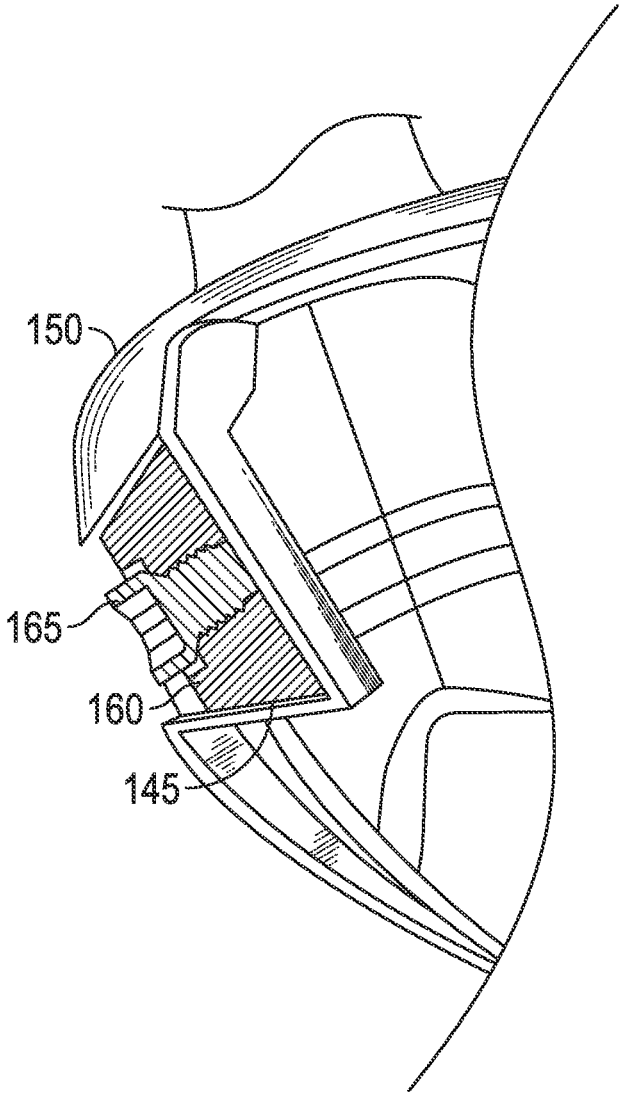
FIG. 15 is a cross-sectional view of the embodiment shown in FIG. 14 along lines 15-15.

A fourth embodiment of the present invention is shown in FIGS. 14 and 15. In this embodiment, the channel 140 is formed from a recessed portion 145 of the sole 14 or ribbon 15 of the golf club head 10 and a separate crown piece 150, which preferably is formed from a composite material, but may in other embodiments be formed from lightweight metal alloys such as magnesium and aluminum alloys, from plastic, or from titanium alloy or stainless steel. As in the third embodiment, the slidable weight 160 of this embodiment is trapezoidal and may be fixed within the channel 140 with a bolt 165 or by any other means disclosed herein. As in the third embodiment, this embodiment may be assembled by placing the slidable weight 160 within the recessed portion 145 and then permanently or removably affixing the crown piece 150 to the rest of the golf club head 10, trapping the slidable weight 160 within the channel 140.

Figure 16:
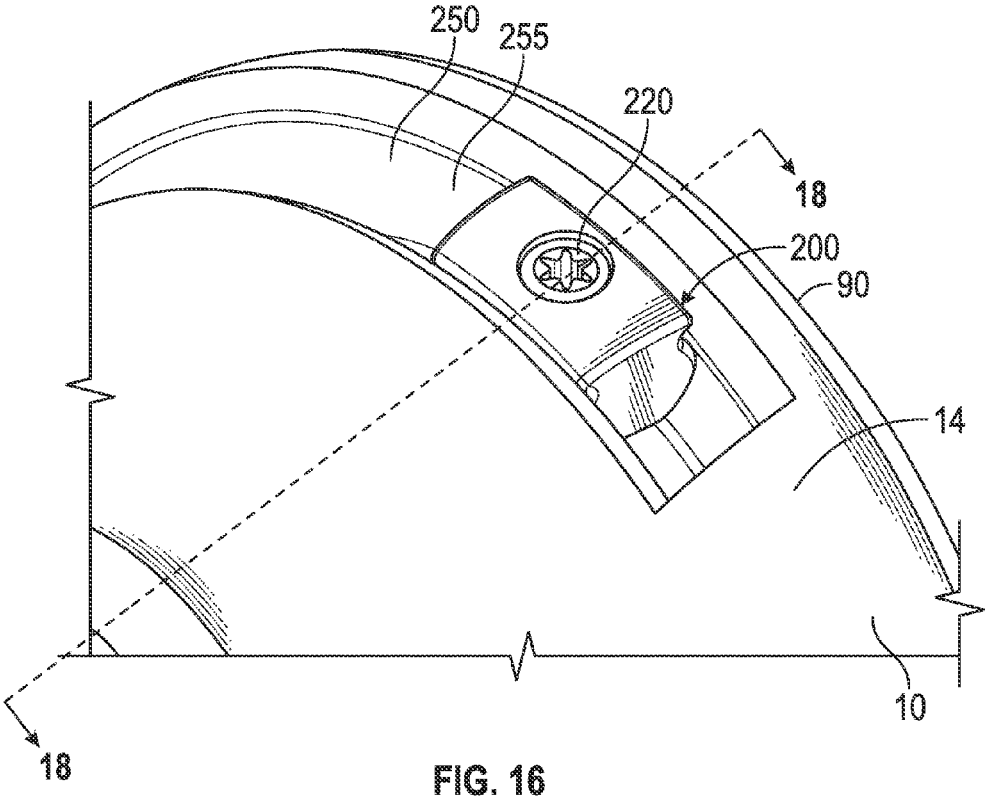
FIG. 16 is a sole perspective view of a portion of a golf club head encompassing a fifth embodiment of the present invention.
Figure 17:
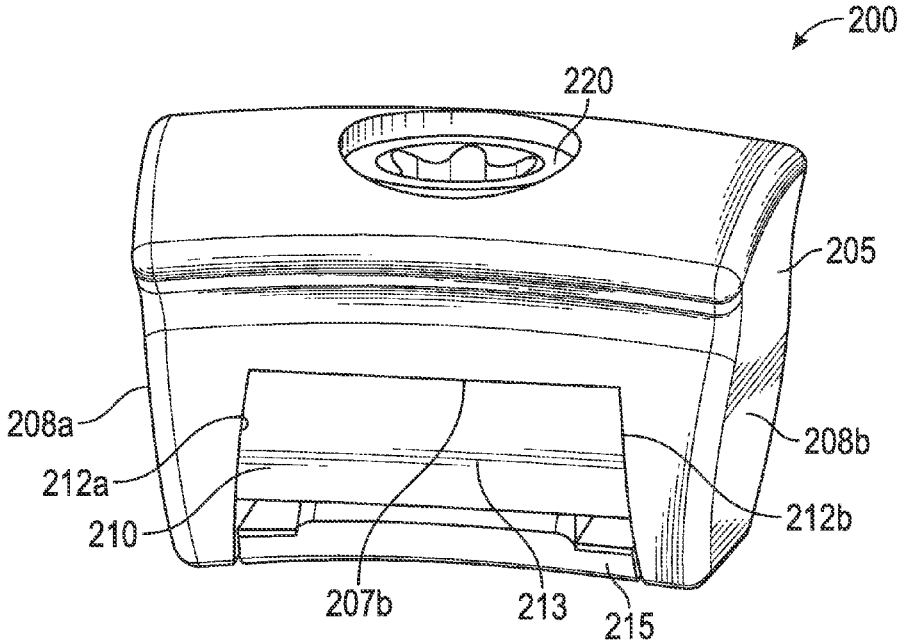
FIG. 17 is a side perspective view of the slidable weight shown in FIG. 16.
Figure 18:
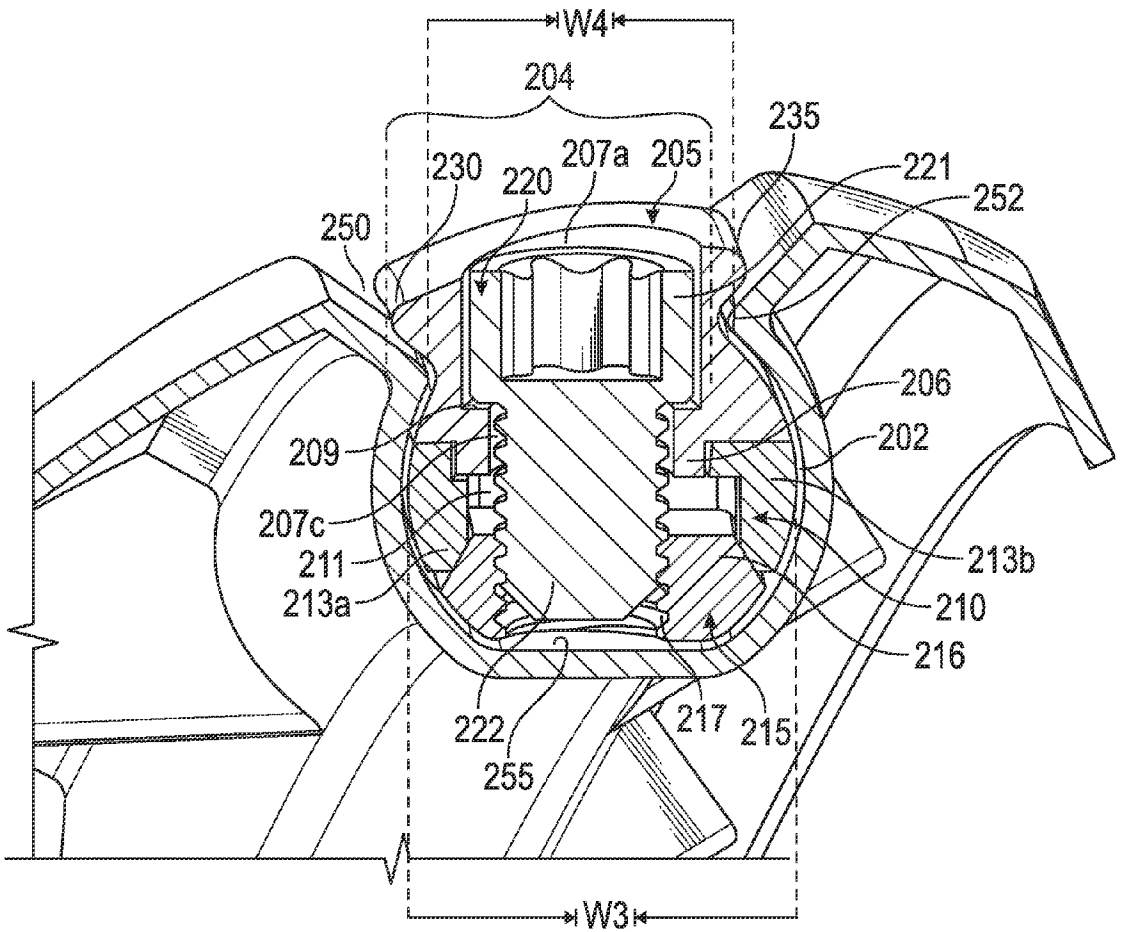
FIG. 18 is a cross-sectional view of the embodiment shown in FIG. 16 along lines 18-18.
Figure 19:
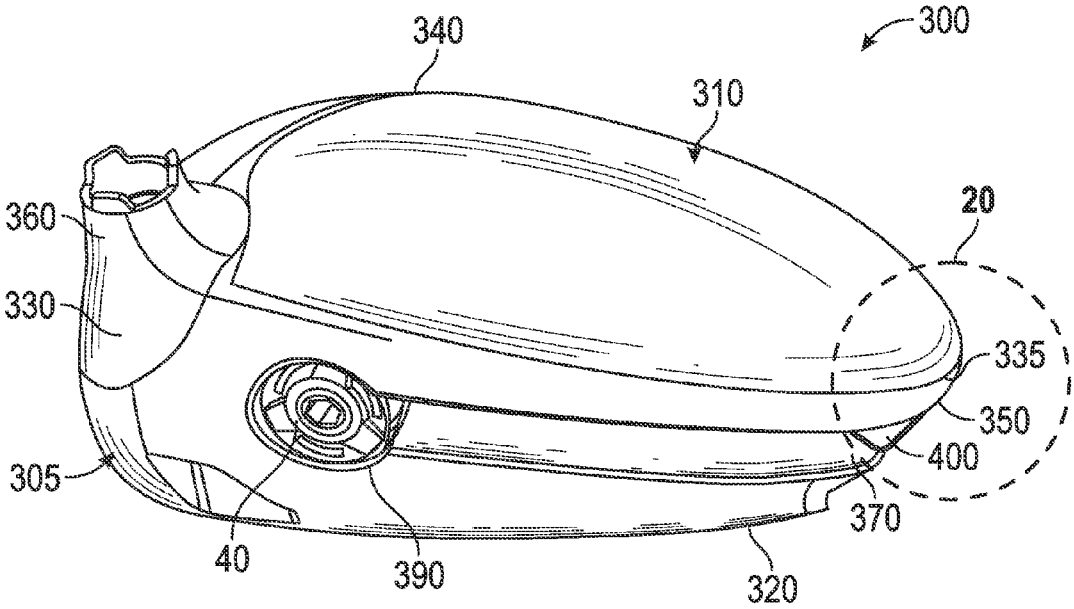
FIG. 19 is a side perspective view of a golf club head encompassing a sixth embodiment of the present invention.
Figure 20:
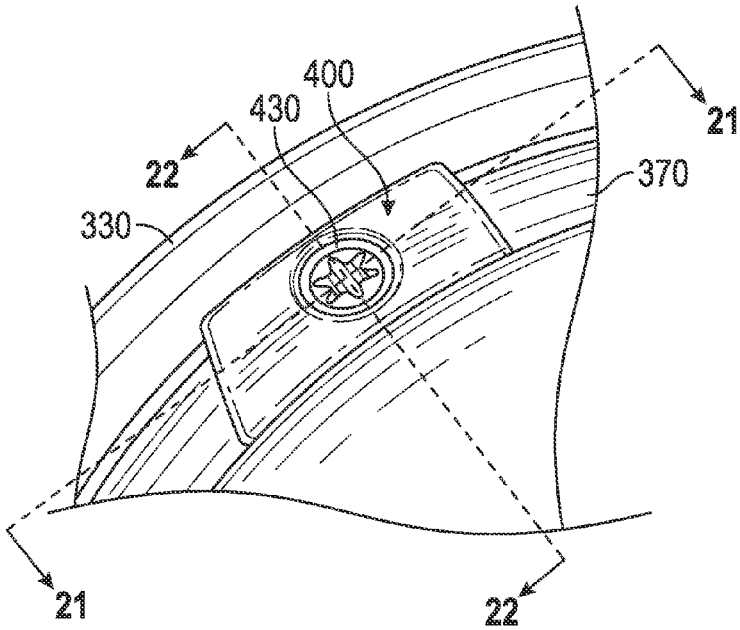
FIG. 20 is an enlarged view of the circled portion of the golf club head in FIG. 19.
Figure 21:
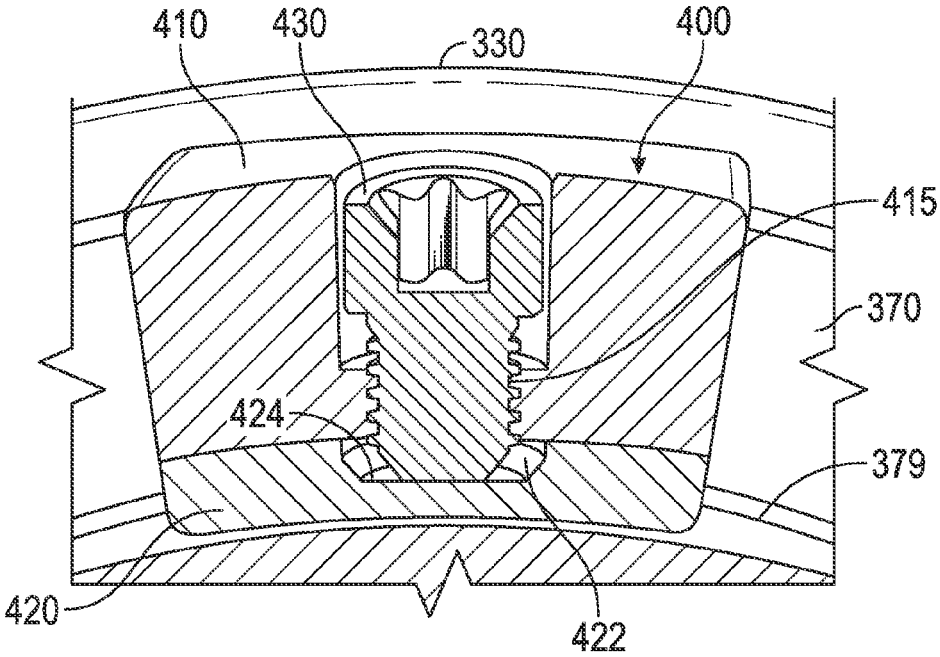
FIG. 21 is a cross-sectional view of the embodiment shown in FIG. 20 along lines 21-21.

A fifth embodiment of the present invention is shown in FIGS. 16-18. This embodiment is similar to the one shown in FIGS. 5-11, but includes a three-piece slidable weight 200 instead of a two-piece slidable weight 50, and the various pieces of the three-piece slidable weight 200 are obscured from view when the slidable weight 200 is disposed within the channel 250 of the golf club head 10. The three-piece slidable weight 200 of the preferred embodiment is also similar to the embodiment shown in FIGS. 4 and 15, in that the bolt 220 makes contact with the floor portion 255 of the channel 250 instead of a portion of the slidable weight 200 when the three-piece slidable weight 200 is fixed within the channel 250.

In the fifth embodiment, the slidable weight 200 includes an upper portion 205 composed of a durable metal material, preferably 17-4 stainless steel, a middle portion 210 composed of a lightweight, expandable material, preferably injection-molded plastic or rubber, and a lower portion 215 composed of a metal material, the composition of which can be adjusted depending on the weighting needs of the golf club head 10. Any of these portions 205, 210, 215, and particularly the upper and lower portions 205, 215, may be co-molded with a polymeric material as desired by the manufacturer. The upper portion 205 includes an upper recess 207*a* sized to receive the head 221 of the bolt 220, an unthreaded through bore 207*c* sized to receive the threaded portion 222 of the bolt 220, and a ledge 209 against which the head 221 of the bolt 220 rests. The lower portion 215 includes a through bore 217 with internal threads 218 that grip the threaded portion 222 of the bolt 220, prevent the bolt from disengaging from the slidable weight 200, and thus hold the portions 205, 210, 215 of the slidable weight 200 together.

As shown in FIG. 17, the upper portion 205 of the slidable weight 200 also includes a lower recess 207*b* sized to receive the middle portion 210, such that the middle portion 210 is flanked on two sides 212*a*, 212*b* by walls 208*a*, 208*b* of the upper portion 205. In this way, when the middle portion 210 is compressed, it is forced to expand outwards at its exposed sides 213*a*, 213*b* and press against the walls of the channel 250. The middle portion 210 further includes an unthreaded through bore 211 sized to receive the threaded portion 222 of the bolt 220, as well as a lower part 206 of the upper portion 205 and an upper part 216 of the lower portion 215. The through bore 211 allows the upper portion 205 and the lower portion 215 to at least partially nest within the middle portion 210 and further holds each of the three portions 205, 210, 215 together without requiring the use of adhesives or other bonding means, though in alternative embodiments one or more of the portions 205, 210, 215 may be bonded together.

The slidable weight 200 has an hourglass-like cross-sectional shape, as shown in FIG. 18, which fits within the hourglass-like cross-sectional shape of the channel 250. This shape exposes a greater surface area 204 of the slidable weight 200 to a user without allowing the slidable weight 200 to fall out of the channel 250 during use. The channel 250 includes a narrow region 252 that retains the slidable weight 200 within the channel 250, as the widest region 202 of the slidable weight 200 has a width W3 that is greater than the width W4 of the narrow region 252 of the channel 250. In this way, the slidable weight 200 is effectively trapped within the channel 250. The hook-like upper edges 230, 235 of the weight 200 act as an anti-rotation feature by preventing the weight 200 from moving from side to side within the channel 250, and thus from rattling in the channel 250 while the golf club head 10 is in use.

When a user wishes to adjust the location of the slidable weight 200 shown in FIGS. 16-18, the user loosens the bolt 220 so that it does not make contact with the floor portion 255 of the channel 250 and then moves the slidable weight 200 to a desired location within the channel 250 which, in the preferred embodiment, is located in the sole 14 at a rear end 90 of the golf club head 10. The user then tightens the bolt 220 so that the threaded portion 222 moves downwards through the threaded bore 217 of the lower portion 215, compressing the middle portion 210 between the upper and lower portions 205, 215, which may cause the middle portion 210 to expand at its exposed sides 213*a*, 213*b* and make contact with the walls of the channel 250. At the same time, as the threaded portion 222 of the bolt 220 extends through the threaded bore 217 and makes contact with and presses against the floor portion 255 of the channel 250, it pushes the lower portion 215, and thus the middle and upper portions 210, 205 upwards, causing the widest region 202 of the slidable weight 200 to press against the narrow region 252 of the channel 250. In this way, the bolt 220 removably fixes the slidable weight 200 at any point within the channel.

A preferred embodiment of the golf club head of the present invention is shown in FIGS. 19-27. In this embodiment, the golf club head 300 has a metal body portion 305 comprising a sole 320, a heel side 330, a toe side 340, a rear end 350, an upper opening 325, a hosel 360, and a face 380, and a composite crown 310 that is adhered to the metal body portion 305 around the edges of the upper opening 325 such that it closes the upper opening 325. An edge portion 335 is defined by the intersection of the crown 310 with the sole 320 of the golf club head 300. As shown in these Figures, the golf club head 300 also includes a channel 370 in the sole 320, which extends from the heel side 330 of the golf club head, through the rear end 350, to the toe side 340, and connects with a weight port 390 in the heel side 330, where an expandable weight 400 can be inserted into or removed from the channel 370. The weight port 390 can be closed using a weight screw 40 or plug disclosed herein. In alternative embodiments, the channel 370 may be disposed in the crown 310 or another portion of the golf club head 300, and the weight port 390 may not be included. As shown in these Figures, the channel has at least two concavely curved side walls 375*a*, 375*b* and a flat floor 373. The channel also preferably includes one or more guide ridges 379 disposed proximate or on the floor 373 to help the weight 400 slide smoothly within the channel 370.

Figure 22:
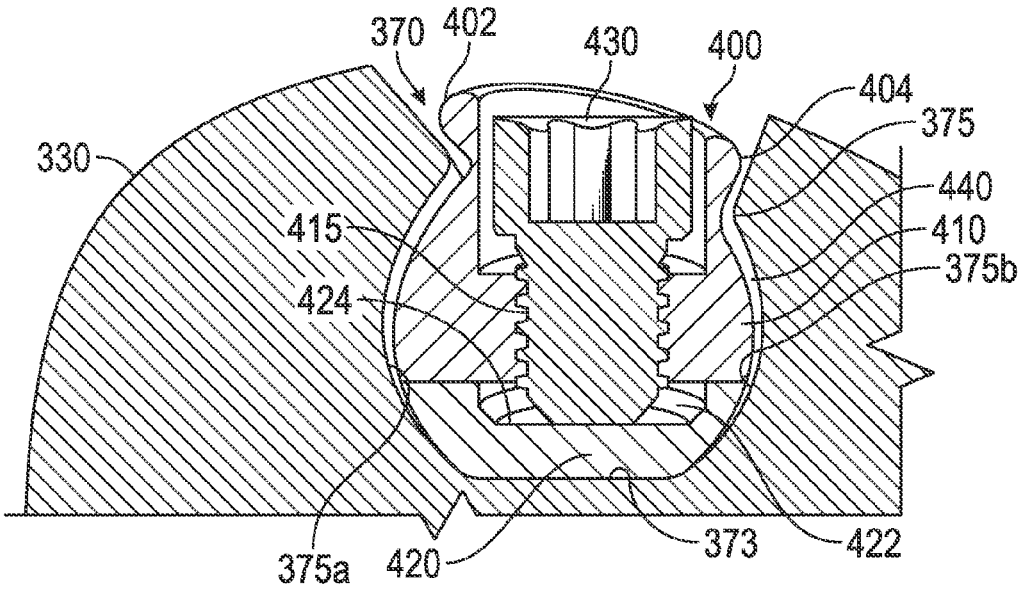
FIG. 22 is a cross-sectional view of the embodiment shown in FIG. 20 along lines 22-22.

The preferred expandable weight 400 shown in FIGS. 19-22 combines certain features of the other weight embodiments disclosed herein. Like the embodiment shown in FIGS. 16-18, the preferred weight 400 has an hourglass-shaped profile with hook-like upper ends or edges 402, 404 that extend over the walls 375 located at the narrowest part of the channel 370 and act as anti-rotation features by preventing the weight 400 from rattling within the channel 370 when the golf club head 300 is in use. In other embodiments, the weight 400 may have other anti-rotation features known to a person skilled in the art. Like the embodiment shown in FIGS. 5-11, the expandable weight 400 is composed of an upper portion 410 having a threaded bore 415, a lower portion 420 having a cavity 422 and a floor 424, and a threaded bolt 430 that engages the threaded bore 415. While in the configuration shown in FIGS. 20-22, the dimensions of the weight 400 are such that it fits loosely within the channel 370 and can be moved along the length of the channel 370, though the weight 400 still has a width that is great enough to prevent it from falling out of the channel 370. As shown in FIG. 22, the weight 400 does not have the same cross-sectional profile as the channel 370 at all locations within the channel 370 due to the channel's 370 geometry—as discussed in the following sections, the channel 370 twists as it curves around the golf club head 300—so at most locations within the channel, there is a slight gap 440 between the weight 400 and the channel 370 walls 375.

When a golfer has moved the weight 400 to a desired position within the channel 370, he or she can tighten the bolt 430, which causes the bolt 430 to move downward within the threaded bore 415 into the cavity 422 of the lower portion 420, press against the floor 424 of the cavity 422, and push the upper portion 410 of the weight 400 away from the lower portion 420. As it is pushed upwards, the upper portion 410 of the weight 400 presses against the walls of the channel 370, effectively using friction to wedge the expandable weight 400 into a fixed position within the channel 370. In the preferred embodiment of the weight 400 shown in FIGS. 20-22, at least one, and preferably both, of the upper portion 410 and lower portion 420 of the weight 400 is composed of a metal material, particularly stainless steel, as is the bolt 430.

Figure 23:
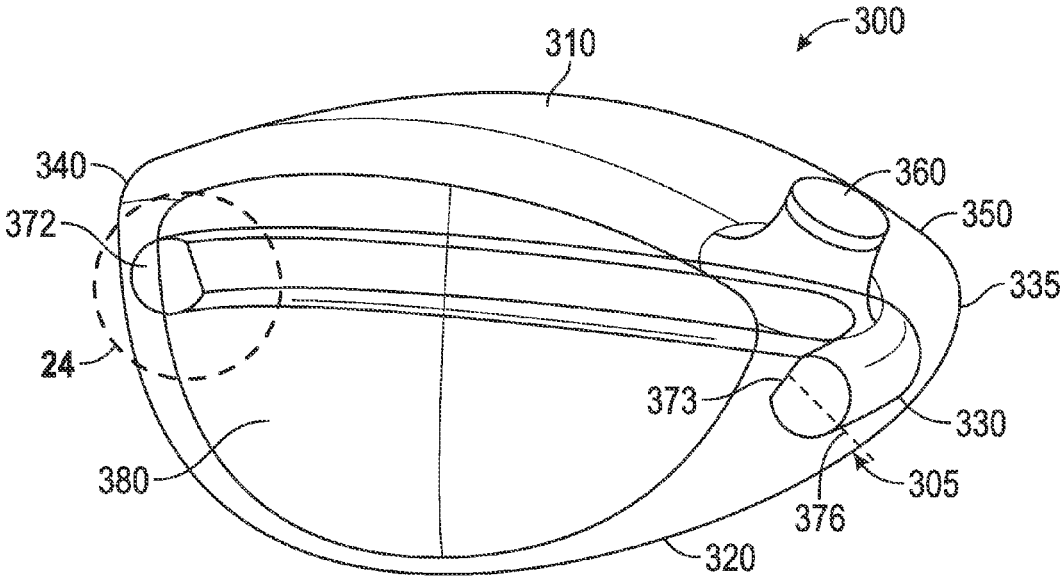
FIG. 23 is a transparent, wire-frame drawing of the embodiment shown in FIG. 19 including a solid shape representing the empty volume or negative space of the channel.
Figure 24:
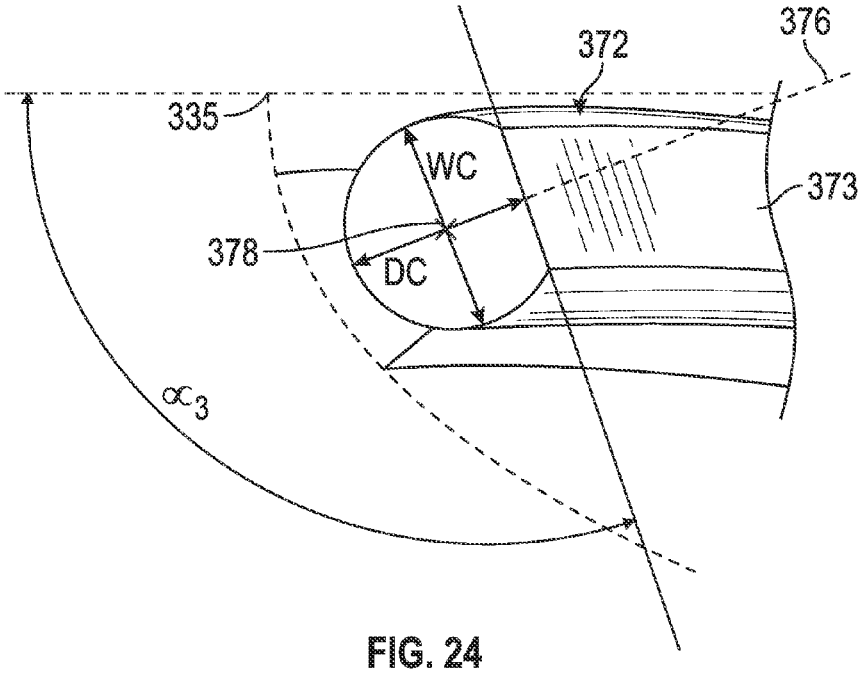
FIG. 24 is an enlarged view of the circled portion of the golf club head shown in FIG. 23, and focuses on the negative space of a small section of the channel.
Figure 25:
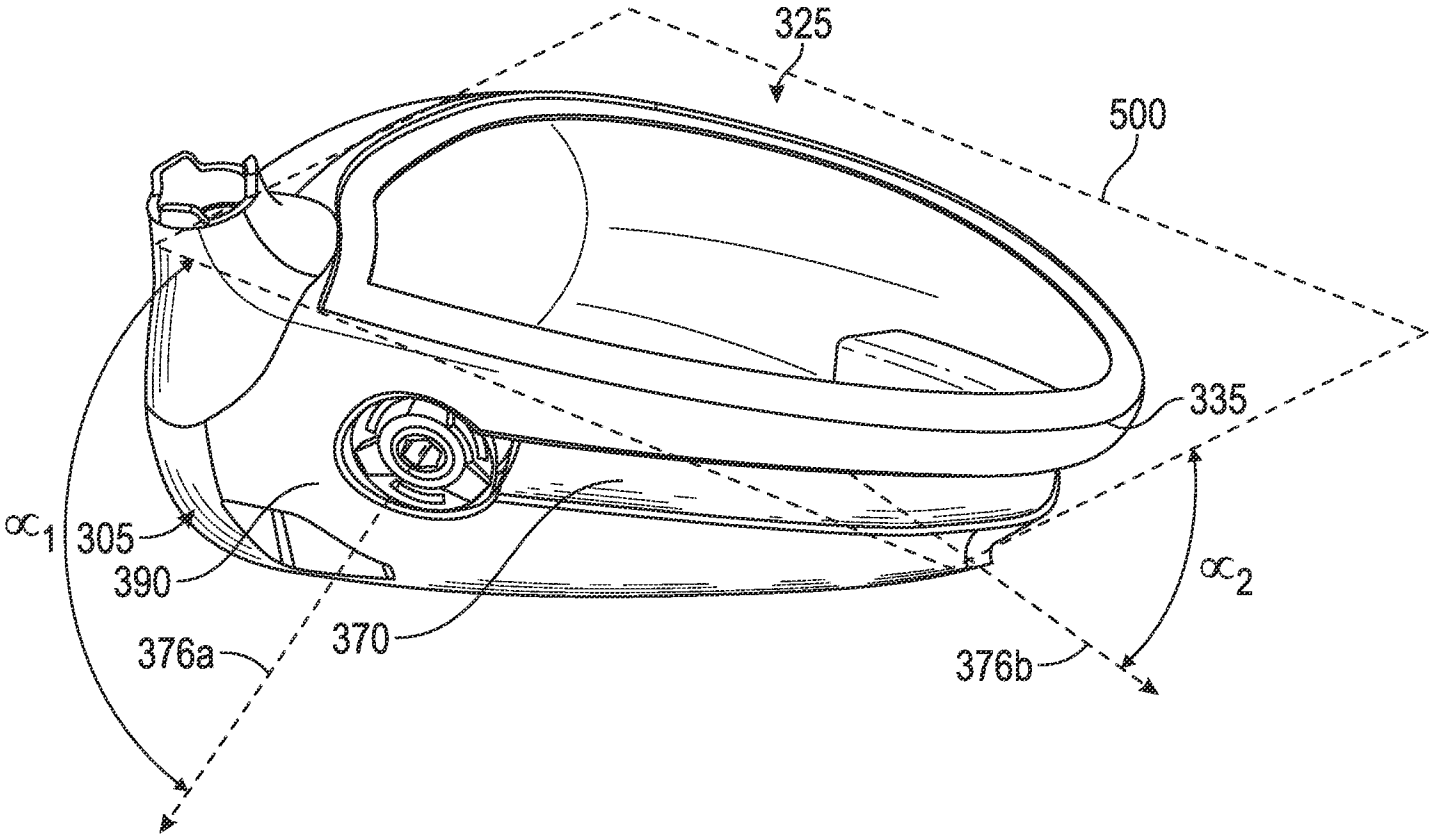
FIG. 25 is another transparent, wire-frame drawing of the embodiment shown in FIG. 19.

The channel 370 of the preferred embodiment is novel because, as mentioned above, its curvature is not constrained to a planar arc, e.g., an arc entirely located within a single plane that intersects the golf club head. An example of a prior art club design having a channel that follows a planar arc is shown in FIG. 1 of U.S. Pat. No. 7,775,905 to Beach et al. Instead, the channel 370 of the present invention twists as it follows the contours of the golf club head body, a characteristic that is illustrated in FIGS. 23 and 24, each of which includes a representation of the negative (empty) space 372 of the channel, defined by the channel walls 375 in the sole 320, and FIG. 25. As shown in these Figures, the flat portion of the negative space 372, which represents the floor 373 of the channel 370, constantly changes the direction in which it faces. More specifically, at each location along the channel 370, the channel 370 comprises an axis 376 that extends normal to the floor 373. The orientation of this axis 376 with respect to a plane 500 that intersects the edge portion 335, shown in FIG. 25, changes along the length of the channel 370. For example, as shown in FIG. 25 at the heel side 330 of the club head 300, the axis 376*a* is oriented at angle $\alpha 1$ with respect to the plane 500, while at the rear end 350 of the club head 300, the axis 376*b* is oriented at smaller angle $\alpha 2$ with respect to the plane 500. This novel channel 370 orientation allows the channel 370 to closely follow the contours, and preserve the overall aesthetics, of the golf club head 300.

The channel's 370 preferred dimensions are shown in more detail in FIG. 24. At any section taken normal to the channel 370, the channel 370 has a diameter or depth $D_C$ that ranges from 0.250 inch to 0.750 inch, more preferably from 0.400 to 0.600 inch, and most preferably approximately 0.450 inch, and a width $W_C$ that preferably is approximately the same as the depth $D_C$, but may differ from the depth and may range from 0.250 inch to 0.750 inch, more preferably from 0.400 to 0.600 inch, and most preferably approximately 0.450 inch. The channel preferably has a midpoint 378 that is horizontally spaced from the edge portion 335 by 0.200 inch to 0.500 inch, more preferably 0.300 to 0.400 inch, and most preferably approximately 0.385 inch. The midpoint 378 of the channel 370 also is vertically spaced from the edge portion 335 by approximately 0.100 to 0.400 inch, more preferably 0.200 to 0.300 inch, and most preferably approximately 0.274 inch. These depth $D_C$ and width $W_C$ dimensions preferably remain constant across the channel 370, such that a cross section of the channel 370 taken normal to the edge portion 335 at any location along the channel 370 will have the same area. Similarly, the distance between the edge portion 335 and the midpoint 378 of the channel 370 should be the same for at least 50% of the locations across the length of the channel 370. In the cross-section of the channel 370 shown in FIG. 24, the floor 373 of the channel 370 has an angle $\alpha 3$ of 113° with respect to the edge portion, though this value changes depending on where along the channel 370 the angle is measured.

Figure 26:
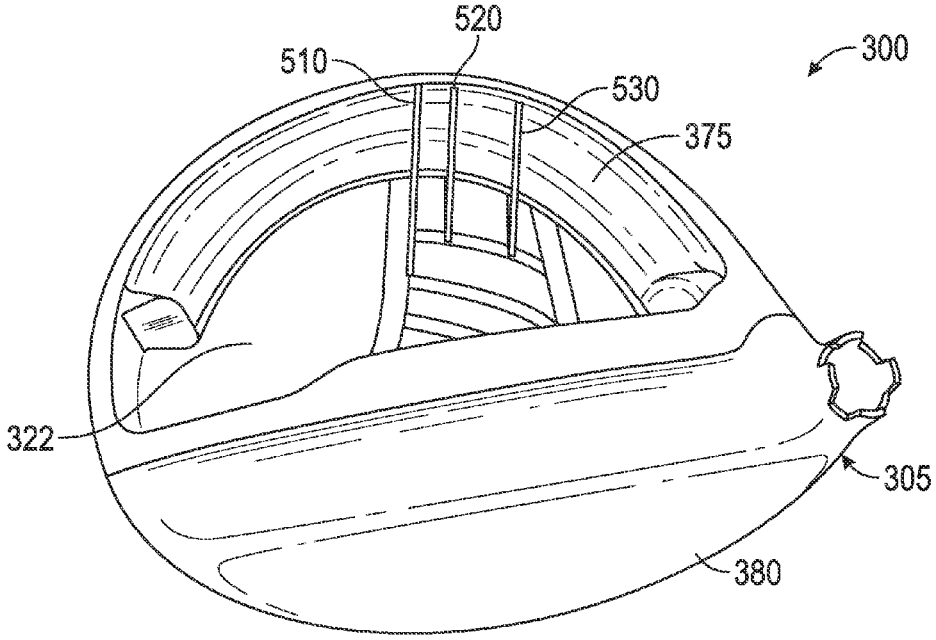
FIG. 26 is a top perspective view of a body portion of the golf club head shown in FIG. 19 without the crown.
Figure 27:
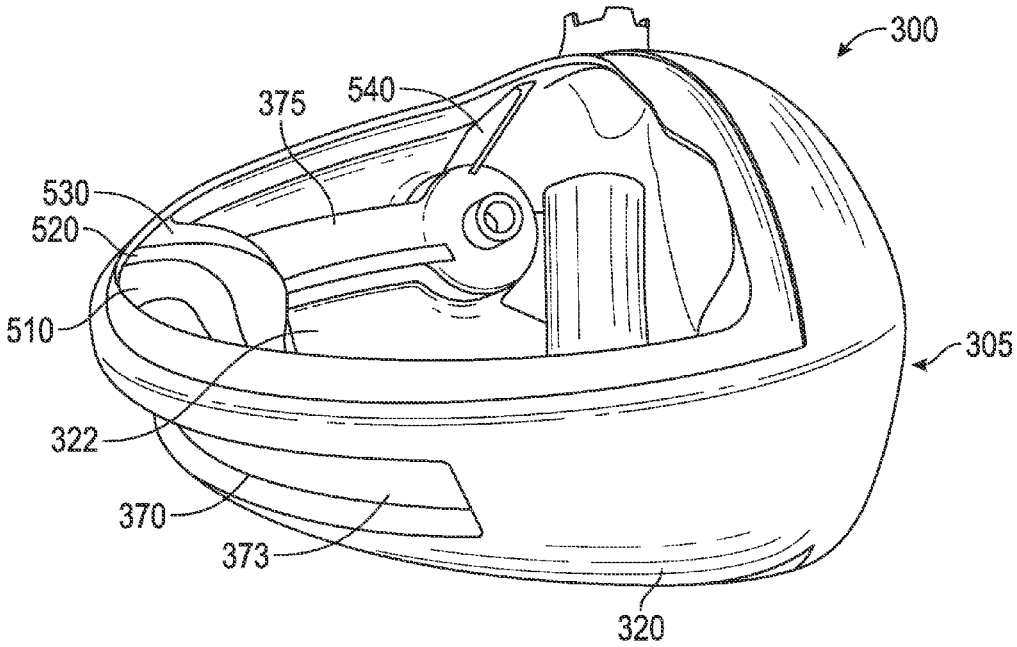
FIG. 27 is a side perspective view of the body portion shown in FIG. 26.

The walls 375, 375*a*, 375*b* and floor 373 of the channel 370 of the present invention preferably are supported by a plurality of ribs 510, 520, 530, 540 that connect the interior surface of the channel 370 walls 375 with an interior surface 322 of the sole 320, as shown in FIGS. 26-27. These ribs 510, 520, 530, 540 prevent the channel 370 from moving too much when the club head 300 is in use, and also improve the overall sound of the golf club head 300. At least three of the ribs 510, 520, 530 are located at the rear end 350 of the golf club head, at an approximate midsection of the channel 370, while the last rib 540 preferably supports the heel-most region of the channel 370 or the weight port 390 to which it connects. The ribs 510, 520, 530, 540 may be composed of the same material as the sole 320, or they may be made of a different material. The ribs 510, 520, 530, 540 preferably are integrally cast with the sole 320 and channel 370, but in other embodiments may be affixed via welding, brazing, adhesive, mechanical fasteners, or other means known to a person skilled in the art, to the interior surface 322 of the sole 320 and the channel 370 after those parts are manufactured.

Figure 28:
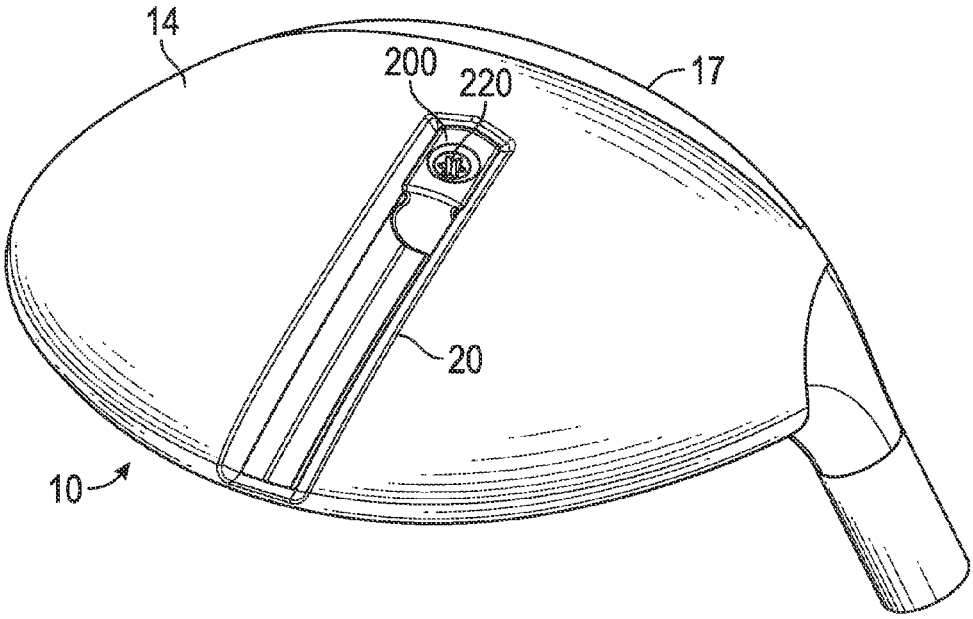
FIG. 28 is a sole perspective view of a golf club head according to a seventh embodiment of the present invention.
Figure 29:
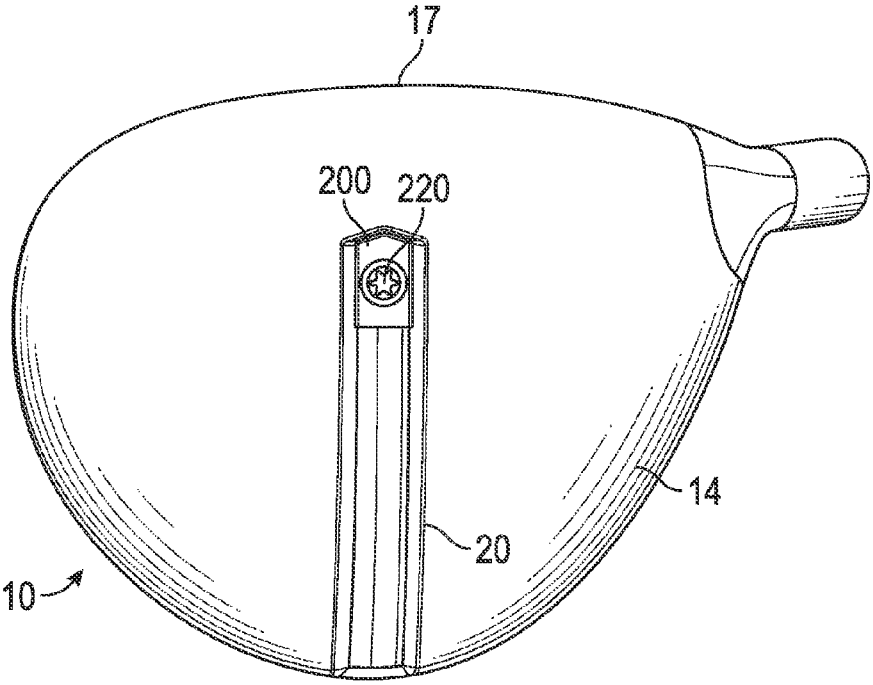
FIG. 29 is a sole plan view of the golf club head shown in FIG. 28.

In alternative embodiments, the channels 20, 120, 140, 250, 370 of the present invention may be disposed in the sole 14 perpendicular to the face 17, as shown in FIGS. 28-29, or on the crown 12. Though the embodiment shown in FIGS. 28-29 is shown with the two-piece slidable weight 400, it may use any of the slidable weight embodiments disclosed herein. In other embodiments, the channel 20 may extend from the sole 14 to the crown 12 or be disposed entirely on the crown 12. In any of the embodiments disclosed herein, the golf club head and slidable weight features may also include the opening 25 and weight screw 40 combination shown in FIGS. 1-6.

In each of the embodiments disclosed herein, the face 17 and sole 14 of the golf club head 10 preferably are formed from a metal material, while the crown 12 is formed from a non-metal material such as composite. In other embodiments, the golf club head 10 may have a multi-material composition such as any of those disclosed in U.S. Pat. Nos. 6,244,976, 6,332,847, 6,386,990, 6,406,378, 6,440,008, 6,471,604, 6,491,592, 6,527,650, 6,565,452, 6,575,845, 6,478,692, 6,582,323, 6,508,978, 6,592,466, 6,602,149, 6,607,452, 6,612,398, 6,663,504, 6,669,578, 6,739,982, 6,758,763, 6,860,824, 6,994,637, 7,025,692, 7,070,517, 7,112,148, 7,118,493, 7,121,957, 7,125,344, 7,128,661, 7,163,470, 7,226,366, 7,252,600, 7,258,631, 7,314,418, 7,320,646, 7,387,577, 7,396,296, 7,402,112, 7,407,448, 7,413,520, 7,431,667, 7,438,647, 7,455,598, 7,476,161, 7,491,134, 7,497,787, 7,549,935, 7,578,751, 7,717,807, 7,749,096, and 7,749,097, the disclosure of each of which is hereby incorporated in its entirety herein.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

I claim:

1. A golf club head comprising a crown, a sole, a hosel, a heel side, a toe side, a face, a rear side opposite the face, an edge portion where the crown connects with the sole, and a channel having a length and a curvature, wherein the channel is disposed in one of the crown and the sole, wherein the channel comprises walls having at least two sides and a floor, wherein an area of a cross-section of the channel taken in a direction normal to the edge portion is constant along the channel, wherein the channel extends from the heel side to the toe side via the rear side and proximate the edge portion along one of the crown and the sole, wherein a heel-most end of the channel is closer to the face than a toe-most end of the channel, and wherein the curvature of the channel is not constrained to a planar arc.

2. The golf club head of claim 1, wherein a distance between the edge portion and a midpoint of the channel remains constant for at least 50% of the length of the channel.

3. The golf club head of claim 1, wherein the golf club head is a wood-type golf club head.

4. The golf club head of claim 1, wherein the crown is composed of a carbon material, and wherein the sole and face portion are composed of a titanium alloy material.

5. The golf club head of claim 1, wherein the channel is disposed in the sole.

6. The golf club head of claim 1, wherein the channel is in communication with a weight port.

7. The golf club head of claim 1, wherein the channel has a maximum depth of no less than 0.250 inch and no more than 0.750 inch and a maximum width of no less than 0.250 inch and no more than 0.750 inch.

8. The golf club head of claim 1, wherein the at least two sides are curved and wherein the floor is planar.

9. A golf club head comprising a crown, a sole, a hosel, a heel side, a toe side, a face, a rear side opposite the face, an edge portion where the crown connects with the sole, and a channel having a length and a curvature, wherein the channel is disposed in one of the crown and the sole, wherein the channel comprises walls having at least two sides and a floor, wherein an area of a cross-section of the channel taken in a direction normal to the edge portion is constant along the channel, wherein the channel extends from the heel side to the toe side via the rear side and proximate the edge portion along one of the crown and the sole, wherein the curvature of the channel is not constrained to a planar arc, and wherein the channel has a depth of approximately 0.500 inch and a maximum width of approximately 0.500 inch.

10. A golf club head comprising:

a body comprising a crown, a sole, a heel side, a toe side, a face portion, and a rear side, an edge portion where the crown connects with the sole, and a channel comprising a length; and an expandable weight that is disposed within and movable to any location within the channel, wherein the channel comprises walls comprising at least two curved sides and a planar floor, wherein the channel extends from the heel side to the toe side via the rear side along one of the crown and the sole, wherein the channel twists relative to a plane intersecting the golf club head at the edge portion as the channel extends around the body, wherein the channel comprises a channel axis that extends normal to the floor of the channel, wherein an angle between the channel axis and the plane does not remain constant along the channel, and wherein expanding the weight reversibly fixes it in place within the channel.

11. The golf club head of claim 10, wherein a distance between the edge portion and a midpoint remains constant for at least 50% of the length of the channel.

12. The golf club head of claim 10, wherein moving the weight within the channel changes both a moment of inertia and a location of a center of gravity of the golf club head.

13. A golf club head comprising:

a body comprising a crown, a sole, a heel side, a toe side, a face portion, and a rear side, an edge portion where the crown connects with the sole, and a channel comprising a length; and an expandable weight that is disposed within and movable to any location within the channel, wherein the channel comprises walls comprising at least two curved sides and a planar floor, wherein the channel extends from the heel side to the toe side via the rear side along one of the crown and the sole, wherein the channel twists relative to a plane intersecting the golf club head at the edge portion as the channel extends around the body, wherein the channel comprises a narrowed portion, wherein the expandable weight comprises an upper surface with hooked upper edges, wherein the hooked upper edges extend over the narrowed portion, and wherein expanding the weight reversibly fixes it in place within the channel.

* * * * *